US010464724B2

(12) United States Patent
Hinnerud et al.

(10) Patent No.: US 10,464,724 B2
(45) Date of Patent: Nov. 5, 2019

(54) CONTAINER

(71) Applicant: Fiedler & Lundgren AB, Malmö (SE)

(72) Inventors: Jacob Elander Hinnerud, Dalby (SE); Adam Berggren, Malmö (SE)

(73) Assignee: Fiedler & Lundgren AB, Malmö (SE)

( * ) Notice: Subject to any disclaimer, the term of this patent is extended or adjusted under 35 U.S.C. 154(b) by 0 days.

(21) Appl. No.: 15/735,503

(22) PCT Filed: Jun. 1, 2016

(86) PCT No.: PCT/EP2016/062402
§ 371 (c)(1),
(2) Date: Dec. 11, 2017

(87) PCT Pub. No.: WO2016/202594
PCT Pub. Date: Dec. 22, 2016

(65) Prior Publication Data

US 2018/0155097 A1 Jun. 7, 2018

(30) Foreign Application Priority Data

Jun. 16, 2015 (GB) ..... 1510505.9

(51) Int. Cl.
*B65D 51/28* (2006.01)
*A24F 23/00* (2006.01)
*B65D 21/08* (2006.01)

(52) U.S. Cl.
CPC ..... *B65D 51/28* (2013.01); *A24F 23/00* (2013.01); *B65D 21/08* (2013.01); *B65D 2209/00* (2013.01)

(58) Field of Classification Search
CPC ..... A24F 23/00; A24F 23/02; B65D 21/08; B65D 51/28; B65D 55/06; B65D 83/08; B65D 2209/00
USPC ..... 206/236, 242–275; 220/529, 530
See application file for complete search history.

(56) References Cited

U.S. PATENT DOCUMENTS

| | | | | |
|---|---|---|---|---|
| 1,630,437 A | | 5/1927 | Kjellstrom | |
| 2,657,802 A | | 11/1953 | Reed | |
| 3,348,724 A | | 10/1967 | Rosso | |
| 3,351,225 A | * | 11/1967 | Speas | B65D 81/3233 220/530 |
| 3,419,198 A | | 12/1968 | Pettersen | |
| 3,426,939 A | | 2/1969 | Young | |

(Continued)

FOREIGN PATENT DOCUMENTS

| | | |
|---|---|---|
| CA | 2223335 A1 | 6/1999 |
| CA | 2252215 A1 | 5/2000 |

(Continued)

OTHER PUBLICATIONS

Swedish Match Press Release, The future of SNUS. Apr. 7, 2003.

(Continued)

*Primary Examiner* — Bryon P Gehman
(74) *Attorney, Agent, or Firm* — McKee, Voorhees & Sease, PLC

(57) ABSTRACT

A container comprising a base and a lid defining a first compartment therebetween for storing unused snus, wherein at least the lid or the base includes a separating element which is stretchable to enable a user to form or enlarge a second compartment for storing used snus on the other side of said separating element to the first compartment.

16 Claims, 3 Drawing Sheets

(56) References Cited

U.S. PATENT DOCUMENTS

| | | | | |
|---|---|---|---|---|
| 3,483,908 | A | 12/1969 | Donovan | |
| 3,910,444 | A | 10/1975 | Foster | |
| 4,089,421 | A | 5/1978 | Porter | |
| 4,098,421 | A | 7/1978 | Foster | |
| 4,165,815 | A | 8/1979 | Vetter | |
| 4,607,768 | A | 8/1986 | Taber et al. | |
| 4,770,318 | A | 9/1988 | Earl | |
| 4,879,442 | A | 11/1989 | Giovine | |
| 4,898,292 | A | 2/1990 | VerWeyst et al. | |
| 4,901,892 | A | 2/1990 | Song | |
| 5,657,802 | A | 8/1997 | Kim | |
| 5,791,473 | A | 8/1998 | Decker et al. | |
| 6,006,937 | A | 12/1999 | Baravaglio et al. | |
| 6,158,632 | A | 12/2000 | Ekkert | |
| 6,162,516 | A | 12/2000 | Derr | |
| D515,439 | S | 2/2006 | Pace | |
| 7,798,319 | B1 | 9/2010 | Bried et al. | |
| D640,546 | S | 6/2011 | Berggren | |
| 8,061,548 | B1 | 11/2011 | Peggs | |
| D650,269 | S | 12/2011 | Berggren | |
| D660,693 | S | 5/2012 | Berggren | |
| 8,348,083 | B2 * | 1/2013 | Light | A47G 19/02 220/529 |
| 8,881,896 | B2 * | 11/2014 | Gibson | A24F 23/00 206/236 |
| 9,497,992 | B2 * | 11/2016 | Evans | A24F 23/02 |
| 9,538,785 | B2 * | 1/2017 | Loos | A24F 23/00 |
| 2003/0066165 | A1 | 4/2003 | Hansen, II et al. | |
| 2003/0172949 | A1 | 9/2003 | Alexander et al. | |
| 2005/0173272 | A1 | 8/2005 | Lemmons, IV | |
| 2005/0175741 | A1 | 8/2005 | Reinders | |
| 2007/0095356 | A1 | 5/2007 | Winterson et al. | |
| 2007/0175909 | A1 | 8/2007 | Solowiejko | |
| 2007/0228051 | A1 | 10/2007 | Meroni | |
| 2009/0014450 | A1 | 1/2009 | Bjorkholm | |
| 2010/0064077 | A1 | 3/2010 | Chung | |
| 2011/0284400 | A1 | 11/2011 | Gibson et al. | |
| 2011/0290682 | A1 | 12/2011 | Gibson et al. | |
| 2012/0168329 | A1 | 7/2012 | Berggren | |
| 2012/0181276 | A1 | 7/2012 | Ichikawa et al. | |
| 2014/0069829 | A1 | 3/2014 | Evans | |
| 2018/0086518 | A1 | 3/2018 | Charm | |

FOREIGN PATENT DOCUMENTS

| | | | | |
|---|---|---|---|---|
| CA | 2536131 | A1 | 2/2005 | |
| CA | 2743082 | A1 | 6/2010 | |
| EP | 0104280 | A1 | 4/1984 | |
| EP | 0611167 | B1 | 8/1994 | |
| EP | 0954478 | B1 | 4/2003 | |
| EP | 1667541 | A1 | 6/2006 | |
| EP | 1667541 | B1 | 6/2006 | |
| EP | 2308769 | A1 | 4/2011 | |
| EP | 2349853 | A1 | 8/2011 | |
| EP | 2349853 | B1 | 8/2011 | |
| EP | 2540641 | B1 | 1/2013 | |
| EP | 2712350 | A1 | 4/2014 | |
| EP | 2767484 | A1 | 8/2014 | |
| EP | 2813440 | A1 | 12/2014 | |
| EP | 2861504 | A1 | 4/2015 | |
| FR | 2873353 | A1 | 1/2006 | |
| GB | 2147875 | A | 5/1985 | |
| GB | 2221443 | A * | 2/1990 | B65D 81/245 |
| GB | 2513163 | A | 10/2014 | |
| GB | 2513164 | A | 10/2014 | |
| JP | 61216 | U | 1/1994 | |
| JP | H06045496 | U | 6/1994 | |
| JP | 8244747 | A | 9/1996 | |
| JP | 3070156 | U | 7/2000 | |
| JP | 2012510260 | A | 5/2012 | |
| NO | 324584 | B2 | 11/2007 | |
| SE | 527350 | C2 | 2/2006 | |
| WO | 96/25337 | A1 | 8/1996 | |
| WO | 9829315 | A1 | 7/1998 | |
| WO | 0147380 | A1 | 7/2001 | |
| WO | 2076844 | A1 | 10/2002 | |
| WO | 03074385 | A1 | 9/2003 | |
| WO | 2005016036 | A1 | 2/2005 | |
| WO | 2006101876 | A2 | 9/2006 | |
| WO | 2008066288 | A1 | 6/2008 | |
| WO | 2008066450 | A1 | 6/2008 | |
| WO | 2010060723 | A1 | 6/2010 | |
| WO | 2010060845 | A1 | 6/2010 | |
| WO | 2011001284 | A1 | 1/2011 | |
| WO | 2011039986 | A | 4/2011 | |
| WO | 2013142671 | A1 | 9/2013 | |
| WO | 2013185838 | A1 | 12/2013 | |
| WO | 2014039786 | A1 | 3/2014 | |
| WO | 2014200423 | A1 | 12/2014 | |

OTHER PUBLICATIONS

The Northerner, Grovsnus White (Swedish Portion Snus), http://www.northerner.com/products/swm884.html, 1 page. downloaded Oct. 7, 2011.

The Northerner, Combi Lid for Tobacco Snuff Cans, http://www.northerner.com/products/swm8810.html, 1 page. downloaded Oct. 14, 2011.

"International Preliminary Report on Patentability", PCT/EP2016/062386 dated Dec. 19, 2017.

Kombilock, https://web.archive.org/web/20041014044049/www.tilbudet.nu/kombilock.jpg, 1 page, dated Oct. 14, 2004.

* cited by examiner

CONTAINER

CROSS-REFERENCE TO RELATED APPLICATIONS

This application is the National Stage of International Application No. PCT/EP2016/062402, filed Jun. 1, 2016, which claims priority to and benefit of Great Britain Patent Application No. 1510505.9, filed Jun. 16, 2015, all of which are herein incorporated by reference in their entirety for all purposes.

BACKGROUND

Field of the Disclosure

The present invention relates to a container for snus.

Description of the Related Art

The "background" description provided herein is for the purpose of generally presenting the context of the disclosure. Work of the presently named inventors, to the extent it is described in the background section, as well as aspects of the description which may not otherwise qualify as prior art at the time of filing, are neither expressly or impliedly admitted as prior art against the present invention.

Snus may be sold either in loose form or in portions disposed in permeable bags and it is packaged in boxes having a resealable lid so to maintain the snus moist. Snus is typically consumed by placing it under the upper lip for an extended period of time, thereafter it should preferably be disposed of in a suitable place such as a bin or the like to avoid littering. However, littering of snus is a common problem as, unlike cigarette smoking, consumption of snus is not restricted to a designated area and so a user may not always be in the vicinity of a bin when discarding used snus.

To overcome the above mentioned problem, it is known to provide containers holding unused snus, wherein the container also comprises a separate compartment for temporarily receiving consumed snus until the user has access to an appropriate bin. However, one of the disadvantages of such a container is that the container is either packaged with less unused snus than a standard container of similar dimensions due to the incorporated second compartment imposing on the space for holding unused snus or, the container must be larger than normal so as to provide an empty separate compartment for receiving used snus.

One proposed solution for dealing with this problem is to provide a container comprising a movable wall which is movable from a first predetermined position to a second predetermined position so as to form the second compartment for storing used snus. This allows a user of the container to form the second compartment only when it is required (for example, when the user has finished using a snus pouch and is not close to a bin). This results in a more efficient use of space in the container. However, the user is limited to moving the movable wall only between these first and second predetermined positions. Thus, if only a small amount of used snus is to be placed in the second compartment (for example, just one or two snus pouches), the movable wall must still be moved to the second position so as to form the second compartment at its full size. This results in wasted space in the second compartment, and reduces the efficiency by which the total volume of the container (as determined by the total volume of the first and second compartments) is utilised.

The present invention aims to alleviate the above-mentioned problems.

SUMMARY

The present invention provides a container comprising a base and a lid defining a first compartment therebetween for storing unused snus, wherein at least the lid or the base includes a separating element which is stretchable to enable a user to form or enlarge a second compartment for storing used snus on the other side of said separating element to the first compartment.

The separating element may be stretchable over a continuous range to enable the user to form or enlarge the second compartment for storing used snus on the other side of said separating element to the first compartment.

The separating element may be a stretchable sheet. The stretchable sheet may have a planar configuration when the first and second compartments are empty. The stretchable sheet may be deformable from a planar configuration so as to form or enlarge the second compartment.

The separating element may be elastically stretchable to enable the user to form or enlarge the second compartment for storing used snus on the other side of said separating element to the first compartment.

The elastically stretchable separating element may be an elastically stretchable sheet. The elastically stretchable sheet may have a planar configuration when the first and second compartments are empty. The elastically stretchable sheet may be deformable from a planar configuration so as to form or enlarge the second compartment.

The lid of the container may comprise an outer frame which supports the separating element. The outer frame may be formed from a single material. In particular, the outer frame may be formed from polyethylene (PE) or polypropylene (PP).

The separating element may be a circular elastically stretchable sheet and the outer frame may comprise a circular portion to which a periphery of the circular elastically deformable sheet is attached under tension.

The second compartment of the container may be closable with a cover.

The first compartment may be filled with unused snus to a level such that, when the lid is attached to the base, and at least when the container is upright, the unused snus does not contact the separating element with a pressure sufficient to deform the separating element. The separating element may be deformable in response to an external pressure so as to form the second compartment. Alternatively, the separating element may be deformable in response to an external pressure so as to enlarge the second compartment. The separating element may be elastically stretchable to enable the user to form or enlarge the second compartment. In particular, the separating element may be a stretchable sheet in a non-deformed, planar configuration. The stretchable sheet may be deformable from the planar configuration in response to an external pressure so as to form the second compartment. Alternatively, the stretchable sheet may be deformable from the planar configuration in response to an external pressure so as to enlarge the second compartment. The stretchable sheet may be elastically stretchable to enable the user to form or enlarge the second compartment.

Alternatively, the first compartment may be filled with unused snus to a level such that, when the lid is attached to the base, a portion of the unused snus contacts the separating element with a pressure sufficient to deform the separating element. The separating element may be deformed such that, once a portion of unused snus is removed from the first compartment, the separating element is reconfigurable so as to form the second compartment. Alternatively, the separating element may be deformed such that, once a portion of unused snus is removed from the first compartment, the separating element is reconfigurable so as to enlarge the second compartment. The separating element may be elastically stretchable to form or enlarge the second compartment. In particular, the separating element may be a stretchable sheet in a deformed, non-planar configuration. The deformed, non-planar configuration may be such that, once a portion of unused snus is removed from the first compartment, the stretchable sheet is reconfigurable so as to form the second compartment. Alternatively, the deformed, non-planar configuration may be such that, once a portion of unused snus is removed from the first compartment, the stretchable sheet is reconfigurable so as to enlarge the second compartment. The stretchable sheet may be elastically stretchable to form or enlarge the second compartment.

The present invention provides a method of filling a container with unused snus, the container comprising a base and a lid defining a first compartment therebetween for storing unused snus, wherein at least the lid or the base includes a separating element which is stretchable to enable a user to form or enlarge a second compartment for storing used snus on the other side of said separating element to the first compartment. The method comprises filling the first compartment with unused snus to a level such that, when the lid is attached to the base, and at least when the container is upright, the unused snus does not contact the separating element with a pressure sufficient to deform the separating element. The separating element may be deformable in response to an external pressure so as to form the second compartment. Alternatively, the separating element may be deformable in response to an external pressure so as to enlarge the second compartment. The separating element may be elastically stretchable to form or enlarge the second compartment. In particular, the separating element may be a stretchable sheet in a non-deformed, planar configuration. The stretchable sheet may be deformable from the planar configuration in response to an external pressure so as to form the second compartment. Alternatively, the stretchable sheet may be deformable from the planar configuration in response to an external pressure so as to enlarge the second compartment. The stretchable sheet may be elastically stretchable to form or enlarge the second compartment.

The present invention provides a method of filling a container with unused snus, the container comprising a base and a lid defining a first compartment therebetween for storing unused snus, wherein at least the lid or the base includes a separating element which is stretchable to enable a user to form or enlarge a second compartment for storing used snus on the other side of said separating element to the first compartment. The method comprises filling the first compartment with unused snus to a level such that, when the lid is attached to the base, a portion of the unused snus contacts the separating element with a pressure sufficient to deform the separating element. The separating element may be deformed such that, once a portion of unused snus is removed from the first compartment, the separating element is reconfigurable so as to form the second compartment. Alternatively, the separating element may be deformed such that, once a portion of unused snus is removed from the first compartment, the separating element is reconfigurable so as to enlarge the second compartment. The separating element may be elastically stretchable to form or enlarge the second compartment. In particular, the separating element may be a stretchable sheet in a deformed, non-planar configuration. The deformed, non-planar configuration may be such that, once a portion of unused snus is removed from the first compartment, the stretchable sheet is reconfigurable so as to form the second compartment. Alternatively, the deformed, non-planar configuration may be such that, once a portion of unused snus is removed from the first compartment, the stretchable sheet is reconfigurable so as to enlarge the second compartment. The stretchable sheet may be elastically stretchable to form or enlarge the second compartment.

The present invention provides a container comprising a base and a lid defining a first compartment therebetween for storing unused snus, wherein at least the lid or the base comprises a second compartment for storing used snus and a separating element for separating the first and second compartments, the separating element being elastically deformable to enable a user to enlarge the second compartment.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
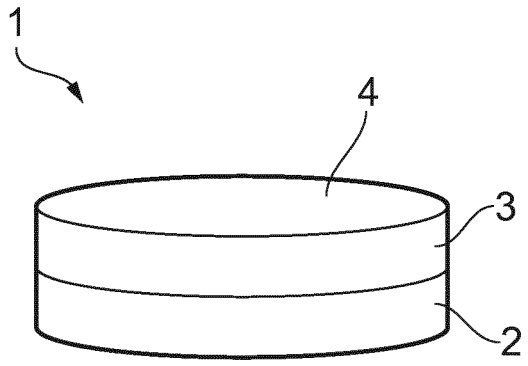
FIG. 1 shows a container according to an embodiment of the present invention.

Referring now to the drawings, wherein like reference numerals designate identical or corresponding parts throughout the several views.

Figure 2:
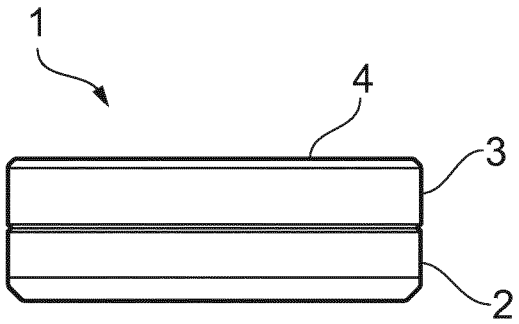
FIG. 2 shows the container from a different perspective.

FIGS. 1 and 2 show a container 1 according to an embodiment of the present invention. The container 1 comprises a base 2, lid 3 and a cover 4. As will be described later on, the base 2 and the lid 3 define a first space or compartment for storing fresh or unused snus, and the lid 3 and the cover 4 define a second space or disposal compartment for holding consumed or used snus.

Figure 3:
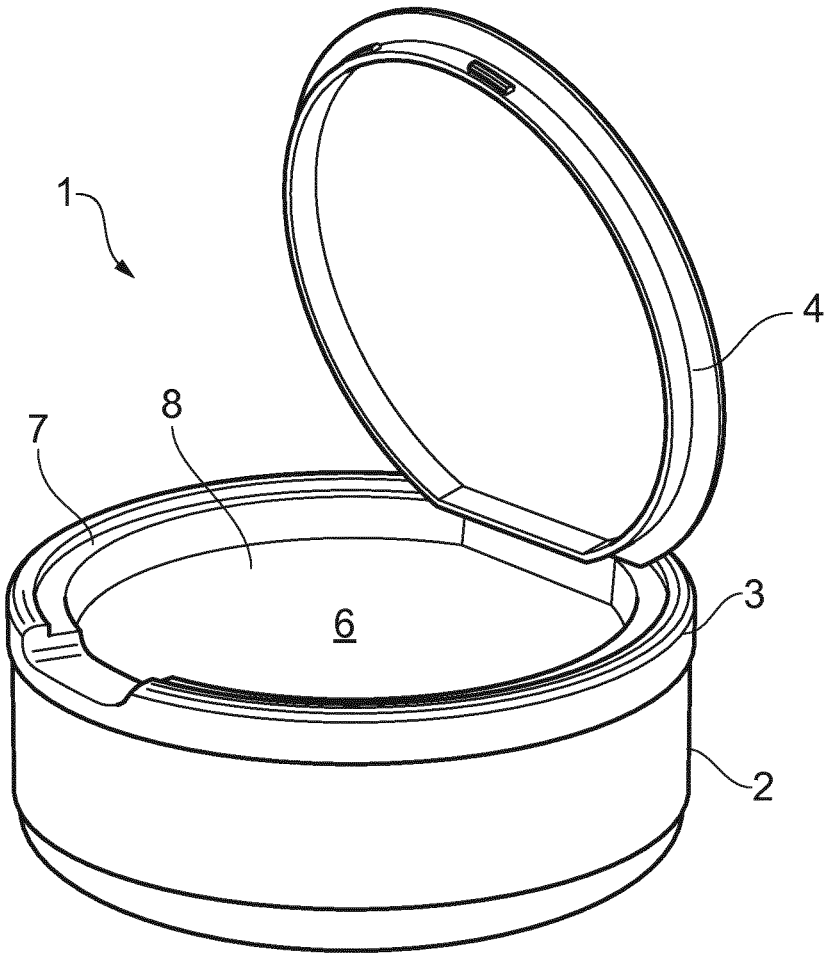
FIG. 3 shows the container in more detail and when a cover of a lid of the container is open.

FIG. 3 shows the container 1 in more detail. In the depiction of FIG. 3, the cover 4 of the container 1 has been opened so as to reveal the second compartment 6 for storing used snus. The first compartment cannot be seen in FIG. 3 because the base 2 is attached to the lid 3, thus enclosing the first compartment. The cover 4 is attached to the lid 3 by means of a hinge so that the cover 4 is openable and closable about the hinge. Alternatively, the cover may be attached to the lid via an alternative mechanism, or the cover may be free, that is, completely detachable from lid. The lid comprises an outer frame 7 which supports a separating element 8, the separating element serving to separate the first and second compartments. The separating element is described in more detail below.

Figure 4A:
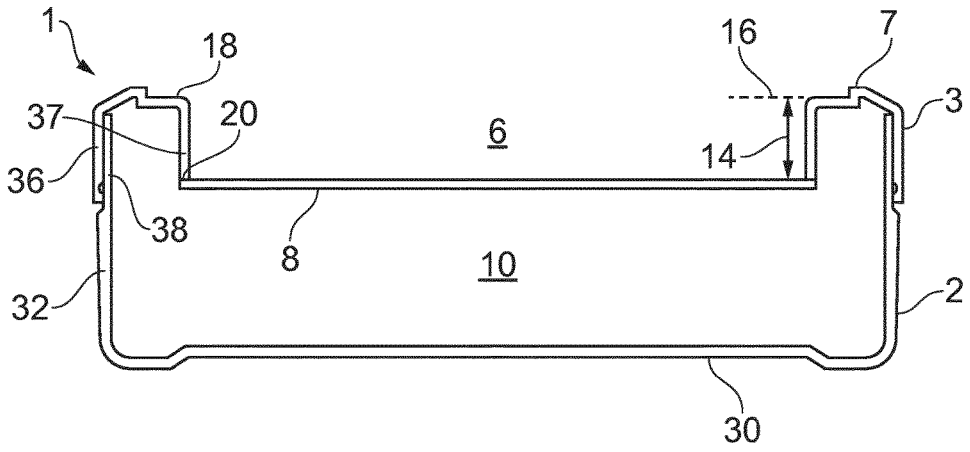
FIGS. 4A and 4B show a simplified cross-section of the container when the lid is attached to a base of the container.
Figure 4B:
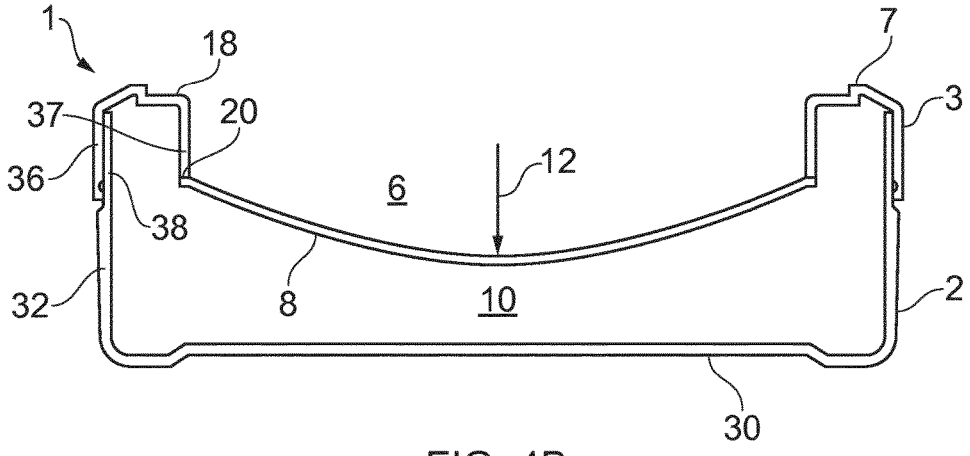

FIGS. 4A and 4B show a cross-section of the container 1 (in which the cover 4 is omitted for clarity). The base 2 comprises a circular bottom wall 30 and a peripheral side wall 32. The lid 3 comprises separating element 8, a peripheral side wall 36, and a side wall 37. An upper portion 38 of the base peripheral side wall 32 has a smaller outer diameter compared to the inner diameter of the lid peripheral side wall 36. This allows the base 2 to receive the lid 3, the lid 3 being releasably attachable to the base 2.

The base 2 and lid 3 define a first compartment 10 for receiving fresh, unused snus. A user is thus able to obtain a piece of unused snus from the first compartment 10 by removing the lid 3 from the base 2. The user will then typically re-attach the lid 3 to the base 2 so that the remaining unused snus remains moist.

In addition, the lid 3 comprises a second compartment 6 for receiving used snus. The second compartment 6 is closable with the cover 4 so as to prevent the used snus from falling out of the second compartment. The lid comprises separating element 8 which separates the first and second compartments. That is, the first compartment 10 is on one side of the separating element 8 and the second compartment 6 is on the other side of the separating element 8. In this embodiment, the separating element 8, together with side wall 37, defines the second compartment.

The separating element 8 is elastically deformable. That is to say, when no external pressure is applied to the separating element 8 (as may occur when the first and second compartments are empty, for example), it maintains a first, predetermined configuration. An example of such a configuration is shown in FIG. 4A, in which the separating element is an elastically deformable sheet which is attached under tension to the side wall 37 so as to take a planar shape when no external pressure is applied to it. On the other hand, when an external pressure is applied to the separating element 8, the separating element deforms in response to the applied pressure so as to take a second, different configuration. The greater the pressure applied, the more the configuration of the separating element will change with respect to the first, predetermined configuration. The separating element will maintain a stable second configuration when the external pressure applied to it is balanced by the elastic resistance of the separating element. An example of such a second configuration is shown in FIG. 4B, in which a pressure in the direction of the arrow 12 has been applied to the separating element 8, thus causing the separating element to deform such that it no longer has a planar configuration. The second configuration shown in FIG. 4B will be stable when the pressure applied in the direction of the arrow 12 is balanced by the elastic resistance of the separating element. If the applied pressure is removed, then the elasticity of the separating element 8 will cause it to return to the first, predetermined configuration.

In the first, predetermined configuration, each of the first and second compartments has a particular respective volume. On the other hand, in the second configuration, the relative sizes of the first and second compartments is changed, meaning that each of the first and second compartments has a different respective volume to that when the separating element is in the first, predetermined configuration. For example, when the separating element is deformed so as to take the second configuration shown in FIG. 4B, it can be seen that the volume of the first compartment 10 (for storing new, unused snus) is reduced relative to when the separating element takes the first, predetermined configuration shown in FIG. 4A, and the volume of the second compartment 6 (for storing used snus) is increased relative to when the separating element takes the first, predetermined configuration shown in FIG. 4A.

In use, the first compartment 10 of the container 1 is initially filled with fresh, unused snus and the second compartment 6 is empty (that is, contains no snus). The first compartment may be filled to a level such that, when the lid 3 is attached to the base 2 and when the container 1 is upright, the unused snus does not contact the separating element 8 with a pressure sufficient to deform the separating element. For example, the first compartment 10 may be filled to a level such that the unused snus does not contact the separating element at all, or to slightly higher level such that the unused snus contacts the separating element, but does not press in to the separating element so as to deform it when the lid 3 is attached to the base 2. The separating element will therefore maintain the first, predetermined configuration shown in FIG. 4A when the first compartment 10 is filled with snus.

At a later time, when the user wishes to store used snus in the container 1 (until they can find a suitable waste receptacle), the user places the used snus in the second compartment 6. When a portion of used snus has been placed in the second compartment 6, a pressure may be exerted on the separating element 8 in the direction of the arrow 12 due to the presence of the used snus. This pressure is caused by the weight of the portion of snus (again, when the container is upright) and may also result from the portion of snus being pushed into the separating element when the cover 4 is closed. The latter will occur if the portion of snus is too large to be accommodated in the second compartment 6 when the cover 4 is closed without the separating element 8 deforming so as to increase the volume of the second compartment. In other words, it will occur when the depth of the second compartment 6 when the separating element 8 is in the first, predetermined configuration (as indicated by the distance 14 in FIG. 4A) is not sufficient for the used snus portion to be accommodated when the cover 4 is closed (the dashed line 16 indicating the position of the inner surface of the cover 4 when the cover 4 is closed). The pressure exerted on the separating element causes the separating element to deform, as previously described, thus increasing the size of the second compartment 6 for storing used snus and reducing the size of the first compartment 10 for storing unused snus.

Advantageously, the use of the elastically deformable separating element allows the relative sizes of the first and second compartments to be changed on a gradual basis as unused snus is removed from the first compartment and, once finished with by the user, added to the second compartment. That is to say, to start with, when the second compartment 6 is empty (that is, contains no snus), no pressure is exerted on the separating element, causing it to maintain the first, predetermined configuration in which the second compartment 6 has a relatively small volume. This leaves a larger volume in the first compartment 10 for storing new, unused snus. Then, as the snus in the first compartment 10 is gradually removed, used and placed in the second compartment 6, the separating element is caused to deform so as to gradually enlarge the second compartment and reduce the size of the first compartment. Thus, the elastically deformable separating element allows the relative volumes of the first and second compartments to be gradually changed in response to the amount of used snus, reducing the occurrence of wasted space in the used snus compartment and providing a more efficient use of the total container volume.

Once the user has found a suitable waste receptacle to dispose of the used snus, the elasticity of the separating component 8 causes it to return to the first, predetermined configuration of FIG. 4A once the used snus has been removed. This once again increases the volume of the first compartment 10, which the user may refill with new, unused snus.

It is noted that, in the embodiment shown in the Figures, the second compartment 6 always exists, but has a smaller volume when the separating element 8 is in the first, predetermined configuration of FIG. 4A. In an alternative embodiment, the separating element may be positioned differently such that the second compartment 6 is only formed when the separating element is deformed (that is, such that the second compartment 6 has zero volume when the separating element is in the first, predetermined configuration). For example, the separating element 8 may be attached to the top edge 18 of the side wall 37 rather than the bottom edge 20 of the side wall 37 (as shown in the Figures) so as to achieve this. Advantageously, this has the effect of maximising the volume of the first compartment 10 for storing used snus, and means that container space is only devoted to the storage of used snus when the user actually presses used snus into the separating element, thus deforming the separating element and forming the second compartment.

In yet another embodiment, the first compartment 10 may be filled with new, unused snus to a level such that the amount of unused snus is too large to be accommodated in the first compartment 10 when the lid 3 is engaged with the base 2 without the separating element 8 deforming so as to increase the volume of the first compartment 10. In this case, as the lid 3 is engaged with the base 2, a portion of the unused snus presses the separating element, thus contacting the separating element with a pressure in the opposite direction to that of the arrow 12 which is sufficient to cause the separating element to deform so as to increase the volume of the first compartment 10 and reduce the volume of the second compartment 6. This advantageously allows the amount of unused snus stored in the container 1 to be increased. In one embodiment, the first compartment 10 may even be filled with unused snus to a level so as to deform the separating element and reduce the volume of the second compartment 6 to zero. In this case, the second compartment is only formed when unused snus is removed from the first compartment 10, this removal reducing the pressure on the separating element and allowing it to return under its own elasticity to a configuration in which the second compartment 6 has a non-zero volume.

The above-mentioned embodiments demonstrate how the use of the elastically deformable separating element 8 gives improved flexibility in the way in which manufacturers and/or users of the container 1 may efficiently use the total volume of the container 1 depending on the relative amounts of used and unused snus.

In the described embodiments, the peripheral side wall 36 and side wall 37 form part of the outer frame 7 of the lid 3. The outer frame 7 provides a support structure for the separating element 8 and may, for example, be formed from a single piece of material such as polypropylene (PP) or polyethylene (PE) via an injection moulding process or the like. The separating element 8 may be formed from any suitable elastically deformable material, such as a natural or synthetic rubber, silicone, or a thermoplastic elastomer (TPE), for example. The separating element 8 is attached along its periphery to the outer frame 7 via any suitable method, such as via a suitable adhesive. The production of the outer frame 7 from a single piece of material followed by the attachment of the separating element 8 provides for a simple manufacturing process of the lid 3. Advantageously, the use of the outer frame 7 allows the benefits of the elastically deformable separating element 8 to be realised and, at the same time, allows the lid 3 to maintain a rigid outer structure which can be easily handled by the user and which enables the user to easily remove and attached the lid 3 to the base 2.

As an alternative to attaching the separating element 8 to the outer frame 7 using an adhesive, the separating element 8 and outer frame 7 may instead be formed together using a two component injection mould (this is possible when the separating element 8 is made from a material which is formable by injection moulding, such as TPE). In this case, a first mouldable material (such as PE or PP) is injected to form the outer frame 7, and then a second mouldable material (such as TPE) is injected to form the separating element 8. After the injection moulding process is complete, the separating element 8 and outer frame 7 then exit the mould as a single unit, thus removing the need for the separating element 8 to be attached to the outer frame via an adhesive or the like. Advantageously, this results in an easier manufacturing process for the lid 3 (the only thing that then subsequently needs to be done to complete the lid 3 is to attach the cover 4 to the lid 3) and a strong and consistent bond between the periphery of the separating element 8 and the outer frame 7.

In the embodiments shown in the Figures, the separating element 8 is a circular elastically deformable sheet and is attached under tension along its periphery to an edge of the circular side wall 37 (the edge of the circular side wall 37 being a circular portion of the outer frame 7). Advantageously, such an arrangement means that a user may apply pressure to any point on the separating element 8 and experience a substantially consistent resistance (due to the elasticity of the separating element 8). The separating element 8 is thus deformable in a consistent and predictable way and makes the container (and, in particular, the second compartment) easier to use.

It is noted that the arrangement of the container 1 relates to only one embodiment of the invention, and that the separating element and first and second compartments may be arranged differently. For example, instead of being located in the lid 3, the second compartment 6 may instead be located in the base 2. In this case, the circular bottom wall 30 of the base 2 may instead comprise the separating element, which, together with a side wall (not shown, but similar to the side wall 37 in the embodiment of FIGS. 4A and 4B), defines the second compartment 6 in a bottom portion of the base 2. The second compartment 6 will then be closable with a separate bottom cover (not shown) so as to prevent the used snus from falling out.

It is also noted that, in the above-described embodiments, the separating element 8 may, alternatively, be plastically deformable instead of elastically deformable (this may be achieved if the separating element 8 is formed from low density polyethylene (PE), for example). In this case, when pressure is applied to the separating element 8 so as to deform the separating element 8 (as occurs when the second compartment 6 is filled with used snus, for example), and that pressure is then subsequently removed (as occurs when used snus is removed from the second compartment, for example), the separating element 8 will not return to the (planar) first, predetermined configuration. Rather, it will stay in the deformed configuration. Alternatively, the separating element 8 may be elastic, but not have sufficient elasticity such that it returns to the first, predetermined configuration after being deformed (this may be achieved if the separating element 8 is formed from a thermoplastic elastomer (TPE), for example). In this case, once applied pressure is removed from the separating element 8, the separating element 8 will change its configuration under its own elasticity, but not to the extent that it fully returns to the first, predetermined configuration.

Both such alternative arrangements remain advantageous, however, since they each still allow the relative volumes of the first and second compartments to be gradually changed depending on the amount of unused and used snus (respectively) stored in these compartments. In fact, this advantage will still be realised as long as the separating element 8 is deformable by way of it being stretchable, no matter whether it stretches fully plastically (so that the separating element 8 remains in a deformed configuration when applied pressure is released), fully elastically (so that the separating element 8 fully returns to the first, predetermined configuration when applied pressure is released) or in between these two extremes (so that the separating element 8 neither remains in the deformed configuration nor fully returns to the first, predetermined configuration when applied pressure is released). It is particularly advantageous if the separating element 8 is deformable by way of it being stretchable over a continuous range (that is, stretchable such that a first point on the separating element 8 can be stretched away from a second point on the separating element such that the distance between the first and second points increases in a smooth, continuous manner). The skilled person will appreciate that the extent to which the separating element 8 returns to the first, predetermined configuration when applied pressure is released will depend on the elasticity of the material chosen to form the stretchable separating element 8 at the pressures expected to be applied to the separating element 8 by the user during normal use. Different materials and/or grades of the same material may be used so as to achieve the desired elasticity (for example, a fully elastic separating element 8 may be formed from a first grade of TPE, a partially elastic separating element 8 may be formed from a second, different grade of TPE with a lower elasticity than that of the first grade of TPE, and a fully plastic separating element may be formed from low density PE).

Of course, further different configurations of the container 1 are also possible.

Numerous modifications and variations of the present disclosure are possible in light of the above teachings. It is therefore to be understood that within the scope of the appended claims, the disclosure may be practiced otherwise than as specifically described herein.

Although the present disclosure has been described in connection with some embodiments, it is not intended to be limited to the specific form set forth herein. Additionally, although a feature may appear to be described in connection with particular embodiments, one skilled in the art would recognize that various features of the described embodiments may be combined in any manner suitable to implement the technique.

The invention claimed is:

1. A container comprising a base and a lid defining a first compartment therebetween for storing unused snus, wherein at least the lid or the base includes a separating element which is stretchable to enable a user to form or enlarge a second compartment for storing used snus on an other side of said separating element to the first compartment and allow the relative volumes of the first and second compartments to be gradually changed depending on the amount of unused and used snus stored respectively in the compartments.

2. A container according to claim 1, wherein the separating element is stretchable over a continuous range to enable the user to form or enlarge the second compartment for storing used snus on the other side of said separating element to the first compartment.

3. A container according to claim 1, wherein the separating element is a stretchable sheet.

4. A container according to claim 3, wherein the stretchable sheet has a planar configuration when the first and second compartments are empty.

5. A container according to claim 4, wherein the stretchable sheet is deformable from the planar configuration so as to form or enlarge the second compartment.

6. A container according to claim 1, wherein the separating element is elastically stretchable to enable the user to form or enlarge the second compartment for storing used snus on the other side of said separating element to the first compartment.

7. A container according to claim 1, wherein the lid comprises an outer frame which supports the separating element.

8. A container according to claim 7, wherein the outer frame is formed from a single material.

9. A container according to claim 7, wherein the outer frame is formed from polyethylene (PE) or polypropylene (PP).

10. A container according to claim 7, wherein:

the separating element is a circular elastically stretchable sheet; and the outer frame comprises a circular portion to which a periphery of the circular elastically stretchable sheet is attached under tension.

11. A container according to claim 1, wherein the second compartment is closable with a cover.

12. A container according to claim 1, wherein the first compartment is filled with unused snus to a level such that, when the lid is attached to the base, and at least when the container is upright, the unused snus does not contact the separating element with a pressure sufficient to deform the separating element.

13. A container according to claim 1, wherein the first compartment is filled with unused snus to a level such that, when the lid is attached to the base, a portion of the unused snus contacts the separating element with a pressure sufficient to deform the separating element.

14. A method of filling a container according to claim 1 with unused snus, the method comprising filling the first compartment with unused snus to a level such that, when the lid is attached to the base, and at least when the container is upright, the unused snus does not contact the separating element with a pressure sufficient to deform the separating element.

15. A method of filling a container according to claim 1 with unused snus, the method comprising filling the first compartment with unused snus to a level such that, when the lid is attached to the base, a portion of the unused snus contacts the separating element with a pressure sufficient to deform the separating element.

16. A container comprising a base and a lid defining a first compartment therebetween for storing unused snus, wherein at least the lid or the base comprises a second compartment for storing used snus and a separating element for separating the first and second compartments, the separating element being elastically deformable to enable a user to enlarge the second compartment and allow the relative volumes of the first and second compartments to be gradually changed depending on the amount of unused and used snus stored respectively in the compartments.

* * * * *